United States Patent [19]

Cox

[11] 3,933,273

[45] Jan. 20, 1976

[54] DISPENSER FOR EXPELLING CONTENTS OF COLLAPSIBLE TUBES AND METHOD OF USING

[76] Inventor: Patrick Clement Cox, "The Pippins", Brimpton, Reading, Berkshire, England

[22] Filed: Feb. 13, 1974

[21] Appl. No.: 442,186

[30] Foreign Application Priority Data

| | | |
|---|---|---|
| Feb. 15, 1973 | United Kingdom | 7499/73 |
| May 14, 1973 | United Kingdom | 22779/73 |
| Aug. 24, 1973 | United Kingdom | 40276/73 |

[52] U.S. Cl. ..... 222/1; 222/95; 222/391; 401/169

[51] Int. Cl.[2] ..... B65D 35/30

[58] Field of Search ..... 222/95, 105, 214, 391, 222/1; 401/153, 169

[56] References Cited

UNITED STATES PATENTS

| | | | |
|---|---|---|---|
| 2,009,761 | 7/1935 | Calderara | 401/153 X |
| 2,477,875 | 8/1949 | Hutchason | 222/95 |
| 2,602,571 | 7/1952 | Sherboudy | 222/391 X |
| 2,627,999 | 2/1953 | Swan | 222/95 |
| 2,731,176 | 1/1956 | Crewe | 222/391 X |
| 2,776,075 | 1/1957 | Etter | 222/391 X |

*Primary Examiner*—Drayton E. Hoffman
*Assistant Examiner*—David A. Scherbel
*Attorney, Agent, or Firm*—Oblon, Fisher, Spivak, McClelland & Maier

[57] ABSTRACT

The contents of a collapsible tube are expelled by placing the tube in a close-fitting sleeve having a removable cap with an orifice fitting over the discharge nozzle of the tube and a plunger which engages the other end of the tube and has a diametral groove to receive the crimped closed end of the tube. Movement of the plunger towards the cap causes the wall of the tube to concertina.

19 Claims, 6 Drawing Figures

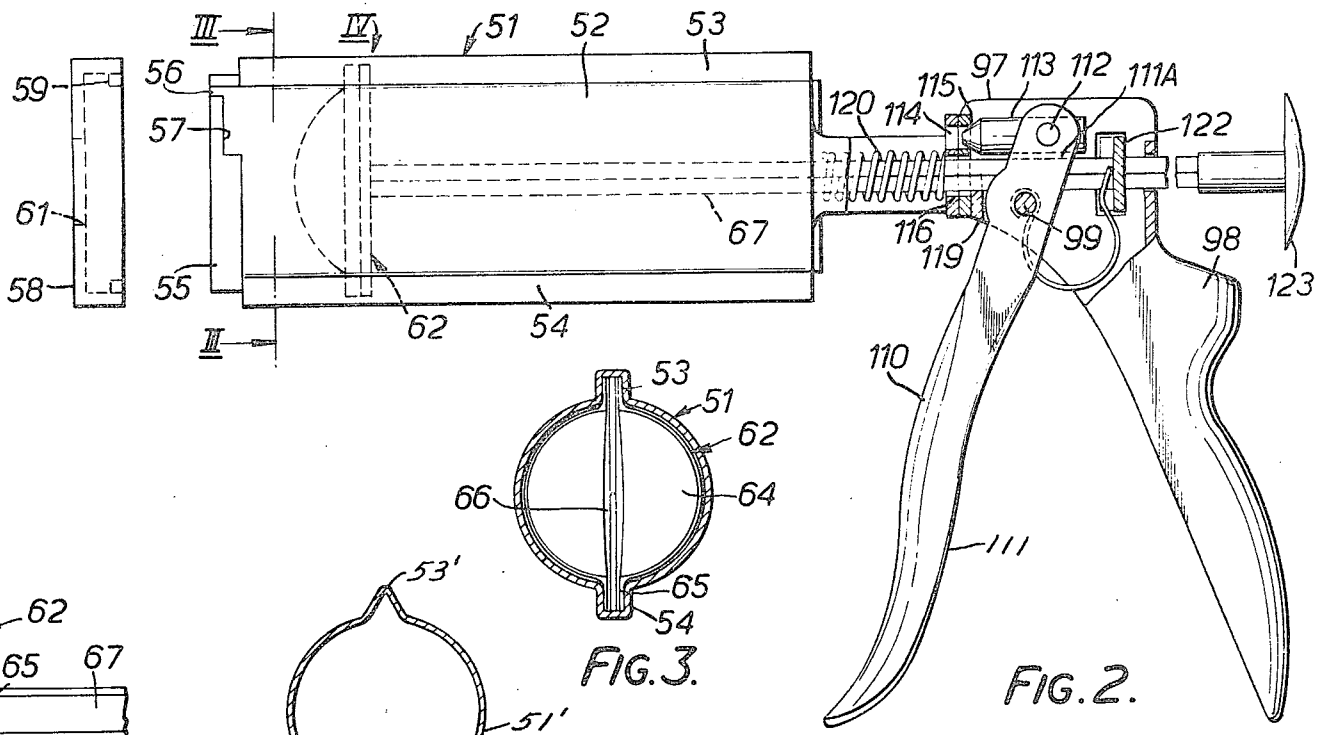
FIG. 2.
FIG. 3.
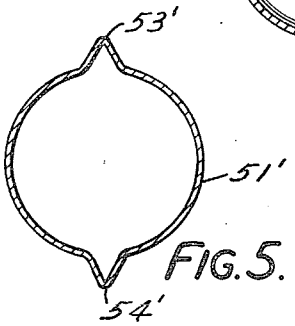
FIG. 5.
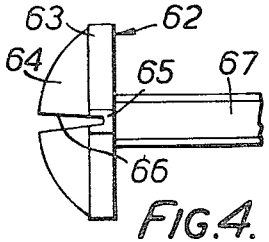
FIG. 4.

DISPENSER FOR EXPELLING CONTENTS OF COLLAPSIBLE TUBES AND METHOD OF USING

This invention relates to the dispensing of the contents of collapsible tubes. These tubes, which are usually made of aluminium foil, are used to dispense many pasty or semi-liquid or liquid materials for domestic, industrial, medical and veterinary purposes.

The contents of collapsible tubes are usually expelled by squeezing the tubes by hand. However, this is slow and can be difficult where the contents are viscous; moreover a considerable proportion of the contents is often left in the tube. Means are known for assisting the rolling up of the tube from the closed end but this provides only a slight improvement.

According to one aspect of the present invention, a method of dispensing material from a collapsible tube comprises placing the tube in a sleeve and compressing the tube axially.

According to a second aspect of the invention, an assembly for dispensing material from a collapsible tube comprises a sleeve, an inwardly extending abutment on the sleeve, and a plunger in the sleeve.

According to a third aspect, an assembly comprises a collapsible tube having at one end a shoulder surrounding a discharge orifice and the other end being closed, and a device for dispensing material from the tube; the device comprising a sleeve containing the tube and having an internal cross-section substantially the same as the external cross-section of the tube, an abutment engaged by the shoulder on the tube, and a plunger engaging the said other end of the tube.

The invention is based on the discovery that if a collapsible tube is enclosed in a sleeve and is then compressed axially from the closed end, the tube collapses from the closed end and the contents are progressively expelled from the discharge orifice or nozzle. In view of the flimsy nature of collapsible tubes it might be thought that compression from the closed end would lead to collapse of the tube at a point near the nozzle end or in the middle so that the contents could not properly be expelled. However, it has been found that this is not the case since a thrust on the closed end increases the pressure of the contents and therefore forces the walls of the tube outwardly into contact with the surrounding sleeve. It has been found that in practice the collapsible tube tends to concertina from the closed end so that substantially the whole contents of the tube can be expelled.

The closed end of a collapsible tube is normally flattened, folded and crimped so that this end is generally wedge-shaped and the width of this end is greater than the diameter of the remainder of the tube. Accordingly the sleeve may have a pair of opposed grooves or slots along which the ears formed by the outer extremities of the wedge portion may travel during compression of the tube. Where the sleeve has a sufficient wall thickness, the sleeve may have a pair of opposed grooves formed in its interior surface which do not produce any corresponding formation at the outside of the tube, but alternatively the sleeve may be of constant wall thickness so that there are ridges on the outside of the sleeve which correspond with the grooves on the inside. Although the grooves may be of rectangular section, they preferably have converging side walls in planes perpendicular to the axis of the sleeve since they correspond approximately to the shape of the part of the collapsible tube adjacent the crimped closed end. The angle of convergence may be between 75° and 80° and the distance between the crests of the internal walls and the grooves should be approximately $\pi$ times the internal radius of the sleeve, i.e. the external radius of the collapsible tube to be used. On the other hand the sleeve may be formed with two diametrically opposite longitudinally extending slots so that the ears actually protrude outside the sleeve. The compression may be effected by a plunger sliding in the tube and in this case the plunger preferably carries lugs which slide in the groove or slots; moreover, the face of the plunger directed towards the tube may be formed with a groove to receive the folded end portion of the tube.

Preferably the plunger has a protuberance on the side engaging the tube to press in axially the centre portion of the tube when collapse of the walls has been completed. Thus at least part of the contents of the narrow bore which is radially within the concertinaed walls can be expelled and where, as is usual, the tube has a conical end wall at least part of the material contained within the hollow of this cone can also be expelled. It has been found that a domed protuberance is satisfactory but other shapes, such as a cone, may be used.

Preferably, at the end of the sleeve opposite to that receiving the plunger there is a releasable abutment to receive the end of the tube having the discharge orifice or nozzle. The releasable abutment may be formed by a cap having releasable attachment means to the sleeve, for example a bayonet joint. This enables the sleeve to be loaded by removal of the cap and insertion of a full tube into the sleeve, the cap then being replaced. Once the contents of the tube have been discharged, the cap can again be removed and the empty tube expelled from the sleeve by further movement of the plunger.

The means for moving the plunger along the sleeve may take various forms and for small tubes the plunger may be moved by hand, for example by providing a knob or other handle on a piston rod connected to the plunger and finger grip means such as ears on the sleeve to be engaged by the fingers. However, for larger tubes greater force is required and a system providing a mechanical advantage is desirable. The plunger may be moved by screw-thread means but preferably the sleeve forms the barrel of a gun having means for incrementally advancing a piston rod by means of a trigger. One suitable mechanism is that described in my British patent No. 1,264,311.

The invention may be carried into practice in various ways but two devices will now be described by way of example with reference to the accompanying drawings, in which:-

FIG. 2 is a side elevation partly in section, of a hand-operated gun;

FIG. 3 is a cross-section through the barrel of the gun on the line III—III in FIG. 2;

FIG. 4 is a plan view of the plunger of the gun in the direction of the arrow IV in FIG. 2;

FIG. 5 is a cross-section similar to FIG. 3 through the barrel of a modified gun.

Figures 1, 6:
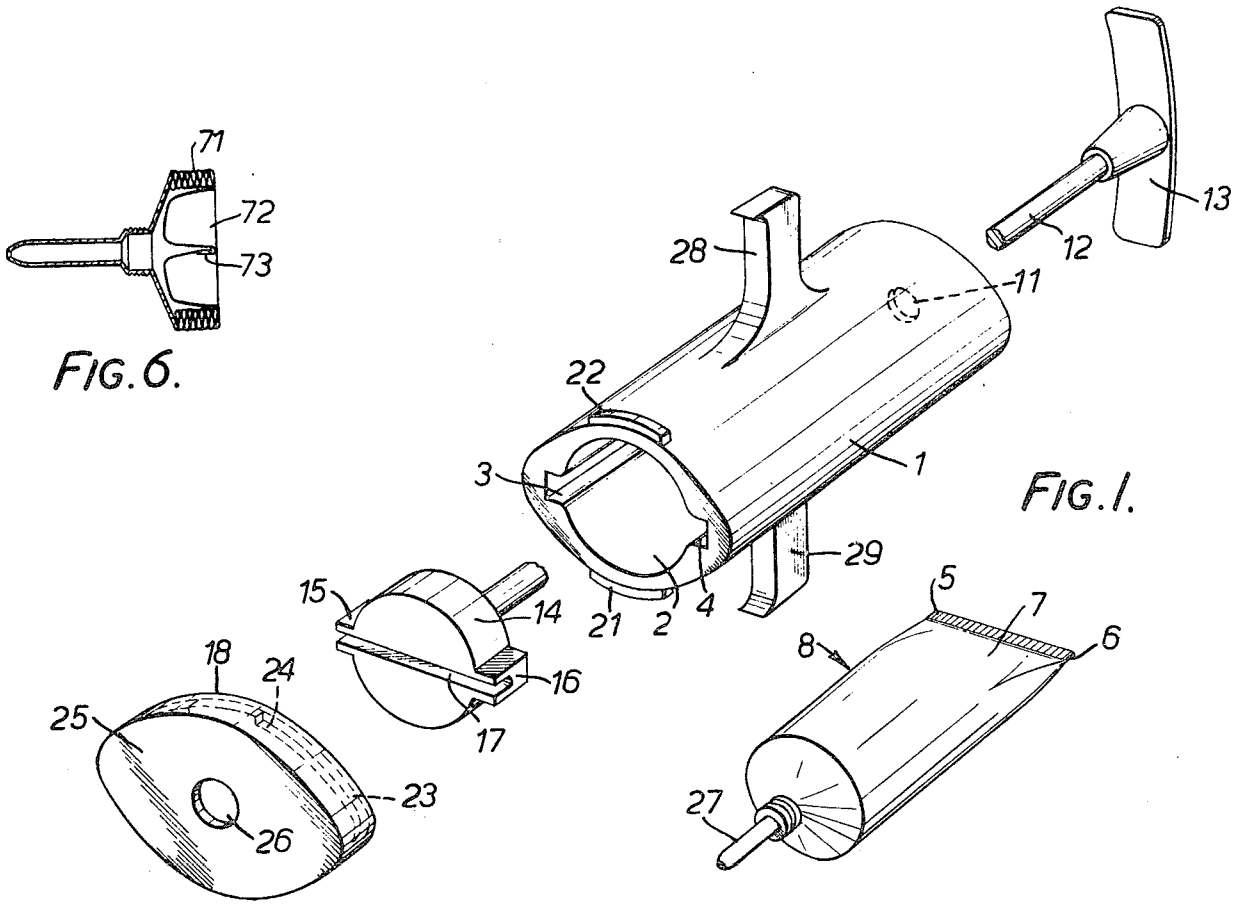
FIG. 1 is an exploded perspective view of a hand-operated dispensing device and the tube to be emptied.
FIG. 6 is a longitudinal section through a collapsible tube emptied by the gun shown in FIGS. 2 to 4.

The device shown in FIG. 1 comprises a sleeve 1 which may be of cast aluminium and which has an axially extending bore 2 which, over the majority of its circumference, is of circular cross-section having a diameter very slightly greater than that of the collapsible tube with which the device is to be used. The bore includes a pair of diametrically opposed axially extending grooves 3 and 4 to receive the ears 5 and 6 formed at the outer corners of a wedge-shaped portion 7 at the closed end of a collapsible tube 8 to be used with the device. One end of the bore 2 is closed by a wall through which there is a circular aperture 11 in which slides a rod 12 having a handle 13 at one end and a plunger 14 at the other end. The plunger is generally circular in cross-section having a diameter slightly less than that of the bore 2 and has a pair of lugs or projections 15, 16 arranged to slide in the grooves 3, 4. Across the face of the plunger 14 there is a groove 17 to receive the folded and crimped end of the tube 8. The apparatus also includes a cap 18 which can be fitted over the end of the sleeve 1 and secured thereon by a bayonet coupling comprising a pair of lugs 21, 22 on the sleeve and an inwardly directed flange 23 on the cap 18, the flange 23 having gaps 24 to receive the lugs 21, 22. The end wall 25 of the cap has an aperture 26 through which the nozzle 27 of the tube 8 can pass. The cap is a loose fit on the sleeve 1 so that it can be rotated a small amount to engage the lugs 22 under the flange 23.

The apparatus is used as follows. The cap 18 is removed from the sleeve and the collapsible tube 8 is slid into the bore 2 with the ears 5 and 6 sliding down the grooves 3 and 4 and the end of the tube being received in the groove 17 in the face of the plunger 14. The cap is then replaced on the sleeve with the nozzle 27 extending through the aperture 26. When the apparatus is to be used, the index and second fingers of the hand of the operator are hooked around two lugs 28, 29 formed on the sleeve and the palm of the hand or the thumb is engaged against the knob 13. The plunger 14 is then squeezed into the sleeve 1. This causes the collapsible tube to concertina progressively from the closed end so that the contents of the collapsible tube are expressed through the discharge orifice in the nozzle 27. When the piston has been pushed in as far as it can go, it will be found that the collapsible tube has been reduced to a fraction of its original length but its outer diameter has substantially not been altered and the crimped end of the tube has remained intact within the groove 17. The cap 18 is then removed and the empty collapsible tube is expelled from the sleeve by further movement of the plunger 14. The plunger can then be retracted and a new collapsible tube inserted into the sleeve.

The gun shown in FIGS. 2 to 4 has a sheet metal barrel 51 which is somewhat similar to the sleeve 1 of the device shown in FIG. 1. It thus consists of a cylindrical portion 52 having two diametrically opposed longitudinal grooves 53, 54 on its inner surface and corresponding ribs on its outer surface. The forward end of the barrel 51 is formed with an outwardly projecting narrow flange or bead 55 having two diametrically opposed through-notches 56 from each of which there extends a circumferential rebate 57. A cap 58 fits over this flange and has inwardly directed lugs 59 which pass through the notches 56 and are retained in the rebates 57 when the cap is rotated a fraction of a turn relative to the barrel to retain the cap on the end of the barrel. The cap has a central aperture 61.

Sliding in the barrel is a plunger 62 having a generally disc-shaped portion 63 on the front face of which there is a dome-shaped protuberance 64, the maximum diameter of which is slightly less than the diameter of the disc. The disc has a pair of lugs or projections 65 arranged to slide in the grooves 53, 54. A groove 66 extends diametrically across the face of the plunger and extends through the protuberance 64 and the lugs 65. The plunger 62 is connected to a hexagonal piston rod 67 which extends through the end wall of the sleeve to an operating mechanism.

The operating mechanism is located between two spaced side members, one of which is shown at 97, and which side members form the body of the gun. A part 98 corresponding to the stock of a pistol extends downwardly from the rear of the side members. Pivotally mounted on a pin 99 and extending between the side members of the body is a trigger-like member 110 the lower part 111 of which is solid while the upper part 111A is bifurcated, the legs of the bifurcation extending past the sides of the rod 67 and the upper ends of the legs being joined by a short circular bar 112. A pin 113 pivotally mounted on the bar 112 extends generally parallel to the rod and has its forward end tapered so as to fit into an opening 114 in a movable gripper 115 in the form of a plate which has a diamond-shaped opening 116 through which the rod passes. The plate 115 is biased towards the pin 113 by means of a spring 120, the lower end of the plate abutting against the body of the gun as shown at 119.

When the gun is to be used the plunger 62 is retracted in a manner to be described, and the cap 58 is removed from the barrel 51. A full collapsible tube having an outside diameter almost the same as the inside diameter of the barrel 51 is inserted into the barrel with its crimped end portion received in the groove 66 in the plunger 62 and the ears formed by the ends of this crimped portion in the longitudinal grooves 53, 54. The cap 58 is then replaced, the nozzle on the forward end of the collapsible tube protruding through the central aperture 61.

To expel the contents of the tube, the trigger 110 is pulled and moves the pin 113 forwardly against the action of the spring 120 which, as it is below the opening 114, causes the plate 115 to tilt with respect to the rod so that the upper part moves forwardly to cause the sides of the opening 116 to grip the sides of the rod 67. Further movement of the trigger 110 will cause the piston rod 67 and hence the plunger 62 to move forwards to compress the tube and express the contents of the tube. On the release of the trigger the plate 115 is returned by the spring 120 to the initial position during which movement it tilts from the gripping position to a release position in which the sides of the opening 116 are free from the sides of the rod 67 so that the plate 115 slides along the rod.

A spring biased catch 122 is provided to the rear of the trigger to prevent the rod from being moved rearwardly when the trigger is released so that by pulling and releasing the trigger a number of times, the rod and hence the plunger 62 can be advanced in a succession of forward steps. The rod can be returned to its starting position by releasing the catch 122 and drawing the rod backwards by pulling on a flange 123 at the rear end of the rod.

FIG. 6 shows a collapsible tube which has been virtually completely emptied by the gun shown in FIGS. 2 to 4. The Figure shows how the cylindrical side wall 71 has concertinaed and the dome-shaped protrusion 64 on the plunger 62 has produced hollows 72 in the end of the tube on either side of the crimped portion 73 which has been received in the groove 66. It will be seen that the space 74 within the tube has been reduced to a very small figure when compared with the original volume of the uncompressed tube so that the contents of the tube which cannot be expelled and so is wasted is a very small proportion of the total contents.

FIG. 5 shows in cross-section the barrel 51' of a modified gun which, apart from the cross-section of the barrel and corresponding modifications to the plunger, is similar to the gun shown in FIGS. 2 to 4, and accordingly only the modifications will be described. The barrel shown in FIG. 5 is of circular cross-section for the most part, but the grooves 63' and 54' are of V-shaped cross-section with slightly curved transitions at the apex of each groove and between the side walls of the grooves and the circular parts of the barrel. The included angle of each groove is between 75° and 80°. The internal radius of the circular portions of the barrel will be very slightly greater than the outer radius of the collapsible tube to be used in the gun, while the distance between the apexes of the two grooves will be very slightly greater than $\pi$ times the radius of that tube, this being the width of the crimped end of the tube. Other dimensions of the barrel follow from these. The plunger which slides in the barrel has a shape which corresponds to the internal cross-section of the barrel shown in FIG. 5 so that the lugs 65 will be approximately V-shaped rather than rectangular.

It will be apparent that many further modifications may be made of the devices described. For example, the under surface of the cap may be conical to engage the conical shoulder normally found on a collapsible tube. The hole in the cap may be large enough to receive the cover which is usually to be found screwed on to the nozzle of a collapsible tube so that the collapsible tube may be inserted into the device while still sealed. The cover can then be removed immediately before dispensing of the contents of the tube is to begin.

What I claim as my invention and desire to secure by Letters Patent is:

1. A method of dispensing material from a collapsible tube which comprises the steps of:

placing a collapsible tube, having a flat crimped closed end, within a sleeve having axially extending grooves open at one end so as to permit insertion of, and accommodating, laterally projecting ear portions of said collapsible tube which are formed at said closed end of said tube; and compressing said tube by an axially moving plunger also disposed within said sleeve.

2. A method according to claim 1 wherein:

said plunger has a groove in its leading face for receiving said closed end of said tube.

3. A method according to claim 2 wherein said plunger has a protrusion on the leading end and said plunger is advanced sufficiently for the protrusion to produce a depression in the rear end of the axially compressed tube.

4. A method according to claim 3 wherein said tube has a conical wall at its discharge end and said plunger is advanced sufficiently for the protrusion to enter the space bounded by said conical wall.

5. An assembly for dispensing material from a collapsible tube which comprises:

a sleeve having an internal diameter equal to the external diameter of said tube;

said tube having a flat crimped closed end and laterally projecting ear portions formed at said closed end of said tube, the diametrical extent of said flat closed end being greater than said external diameter of said tube;

axially extending groove means, open at one end for permitting insertion of and for accommodating said ear portions of said tube, provided within said sleeve;

an abutment on said sleeve for engaging the discharge end of the tube; and a plunger axially movably disposed within said sleeve for engaging the other end of the tube so as to compress and collapse said tube and dispense said material therefrom when so moved.

6. An assembly comprising:

a collapsible tube having at one end a shoulder surrounding a discharge orifice and the other end being flat, crimped and closed and having laterally projecting ear portions, the diametrical extent of said closed end of said tube being greater than that of said tube;

a sleeve containing said tube and having an internal cross-section substantially the same as the external cross-section of said tube;

a pair of opposed, inwardly opening, longitudinally extending grooves, open at one end, being provided within said sleeve for permitting insertion of and for accommodating said ear portions of said tube;

an abutment upon said sleeve engaged by said shoulder on said tube; and a plunger engaging said other end of said tube;

whereby movement of said plunger toward said abutment compresses said tube to expel the contents of said tube through said discharge orifice.

7. An assembly according to claim 6 wherein said sleeve is of constant wall thickness, there being ridges on the outside of said sleeve which correspond with said grooves on the inside.

8. An assembly according to claim 7 wherein said grooves have converging side walls in planes perpendicular to the longitudinal axis of said sleeve.

9. An assembly according to claim 8 wherein the angle of convergence of the side walls of each of said grooves is between about 75° and about 80°, and the distance between the crests of the grooves is approximately $\pi$ times the internal radius of said sleeve.

10. An assembly according to claim 6 wherein the plunger carries lugs which slide in the grooves.

11. An assembly according to claim 6 wherein the face of said plunger facing said abutment is formed with a groove to receive the folded end portion of a tube.

12. An assembly according to claim 6 wherein said plunger has a protuberance on the side facing said abutment.

13. An assembly according to claim 12 wherein said protuberance is dome-shaped.

14. An assembly according to claim 6 wherein said abutment comprises a releasable cap having a central aperture for a discharge nozzle on the tube.

15. An assembly according to claim 14 wherein the surface of said cap facing said plunger is conical.

16. An assembly according to claim 6 which further includes a piston rod connected to said plunger and having a handle at the end remote from said plunger.

17. An assembly according to claim 16 wherein said sleeve carries finger grip means.

18. An assembly according to claim 6 which further includes a piston rod attached to said plunger and means for incrementally advancing the piston rod by means of a trigger, said incremental advancing means comprising: a one-way gripper arranged for reciprocation longitudinally of the rod by operation and release of the trigger, the gripper being arranged to tilt relative to the axis of the rod between a rod gripping position on the forward stroke of reciprocation of the gripper to advance the rod and a rod-release position on the rearward stroke of reciprocation of the gripper to allow the gripper to return without moving the rod.

19. A dispensing device comprising:

a sleeve having a pair of diametrically opposed longitudinal grooves in its internal surface, each of said grooves having flat converging side walls and being open at one end;

a releasable cap on one end of said sleeve, the cap having a central orifice;

a plunger reciprocable within said sleeve and having a pair of diametrically opposite lugs slidable in said grooves in said sleeve and a diametrical groove extending across the end surface of said plunger facing said cap and parallel with a line joining the two lugs; and a collapsible tube contained within said sleeve with its discharge nozzle projecting through said orifice and its crimped closed end received in said diametrical groove as well as said longitudinal grooves so as to be progressively concertinaed on movement of said plunger toward said cap so as to express the contents of said tube through said discharge nozzle.

* * * * *